US009167856B1

(12) United States Patent
Pacific

(10) Patent No.: US 9,167,856 B1
(45) Date of Patent: Oct. 27, 2015

(54) ARTICLES FOR MAKING AND SUPPORTING A KNEEPAD INSIDE A TROUSER LEG

(76) Inventor: Peter P. Pacific, Dearborn Heights, MI (US)

( * ) Notice: Subject to any disclaimer, the term of this patent is extended or adjusted under 35 U.S.C. 154(b) by 1695 days.

(21) Appl. No.: 12/380,340

(22) Filed: Feb. 26, 2009

Related U.S. Application Data

(63) Continuation-in-part of application No. 11/977,484, filed on Oct. 25, 2007, now abandoned.

(51) Int. Cl.
*A41D 13/06* (2006.01)
*A41D 13/05* (2006.01)

(52) U.S. Cl.
CPC ..... *A41D 13/065* (2013.01); *A41D 13/0568* (2013.01)

(58) Field of Classification Search
CPC . A41D 13/065; A41D 13/06; A41D 13/0543; A41D 13/0587; A41D 13/0593; A41D 13/0556; A41D 13/0568
USPC ..... 2/22, 23, 24, 16, 267, 227, 303, 335, 2/336, 329
See application file for complete search history.

(56) References Cited

U.S. PATENT DOCUMENTS 589,562 A * 9/1897 Gray ..... 2/51
1,254,808 A * 1/1918 Jones ..... 2/51
1,636,553 A * 7/1927 Cruden ..... 2/23
1,856,958 A * 5/1932 Kapitzky ..... 2/300
1,930,748 A * 10/1933 Giorda ..... 36/2 R
2,094,292 A * 9/1937 Cousens ..... 24/316
2,108,461 A * 2/1938 Williams ..... 2/335
3,052,994 A * 9/1962 Johnston ..... 36/2 R
4,062,064 A * 12/1977 Vosatka ..... 2/252
4,110,845 A * 9/1978 Chellis ..... 36/2 R
4,404,689 A * 9/1983 DeWan ..... 2/247
RE32,506 E * 9/1987 Hightower, Jr. ..... 2/22
4,697,286 A * 10/1987 Cho ..... 2/22
5,152,741 A * 10/1992 Farnio ..... 602/79
5,477,559 A * 12/1995 Clement ..... 2/22
5,538,502 A * 7/1996 Johnstone ..... 602/79
5,642,526 A * 7/1997 Thompson ..... 2/79
D393,141 S * 4/1998 Glycenfer ..... D2/742
5,918,310 A * 7/1999 Farahany ..... 2/23
6,058,505 A * 5/2000 Bettencourt ..... 2/24
6,200,194 B1 * 3/2001 Grier ..... 450/64
6,205,583 B1 * 3/2001 Beland ..... 2/16
6,347,403 B1 * 2/2002 Wilcox ..... 2/23

(Continued)

*Primary Examiner* — Alissa L Hoey
(74) *Attorney, Agent, or Firm* — George L. Boller

(57) ABSTRACT

A kneepad pocket is created inside the front of a trouser leg knee by making a cutout in the front of the trouser leg above the knee cap and associating an article (10) with the cutout in a way that creates the pocket. A first part has a fabric piece that forms a perimeter margin surrounding a closeable opening which has a long dimension transverse to the length of the trouser leg and through which a kneepad can be inserted into the pocket. The first part is fit to the cutout in the front of the trouser leg with the fabric piece being attached to the trouser leg. A second part is disposed inside the trouser leg and attached to the trouser leg to form top, bottom, and sides of the pocket. A third part has opposite margins that are transverse to the length of the trouser leg, one of which is attached to the fabric piece of the first part above the closeable opening and the other of which is attached to the second part below the top of the pocket. Other embodiments provide for suspension of the knee pad by a strap. The suspension allows the height of the kneepad along a trouser leg to be adjusted and the kneepad to be disconnected.

15 Claims, 13 Drawing Sheets

(56) References Cited

U.S. PATENT DOCUMENTS

| | | | | |
|---|---|---|---|---|
| 6,393,610 | B1 * | 5/2002 | Parks | 2/22 |
| 6,421,839 | B1 * | 7/2002 | Vo et al. | 2/227 |
| 6,654,962 | B2 * | 12/2003 | DeMott | 2/22 |
| 7,089,596 | B2 * | 8/2006 | Leflet et al. | 2/23 |
| 7,194,770 | B1 * | 3/2007 | Fecenko | 2/227 |
| 7,231,672 | B2 * | 6/2007 | Thomas | 2/400 |
| 7,415,733 | B2 * | 8/2008 | Rampersad | 2/23 |
| 7,490,360 | B2 * | 2/2009 | Meadows | 2/23 |
| 7,596,815 | B2 * | 10/2009 | Grilliot et al. | 2/227 |
| 7,931,521 | B1 * | 4/2011 | Griffin | 450/86 |
| 7,945,968 | B2 * | 5/2011 | Johnson | 2/23 |
| 2003/0150042 | A1 * | 8/2003 | Leflet et al. | 2/23 |
| 2004/0019949 | A1 * | 2/2004 | Crockett | 2/23 |
| 2007/0000030 | A1 * | 1/2007 | Toomey et al. | 2/247 |
| 2007/0050877 | A1 * | 3/2007 | Rampersad | 2/23 |
| 2010/0095422 | A1 * | 4/2010 | Lopez et al. | 2/23 |
| 2010/0235960 | A1 * | 9/2010 | Johnson | 2/23 |
| 2010/0281594 | A1 * | 11/2010 | Paterno | 2/24 |
| 2010/0313322 | A1 * | 12/2010 | Sanchez et al. | 2/24 |

* cited by examiner

ARTICLES FOR MAKING AND SUPPORTING A KNEEPAD INSIDE A TROUSER LEG

REFERENCE TO RELATED APPLICATION AND PRIORITY CLAIM

This application is a continuation-in-part, and claims the priority, of application Ser. No. 11/977,484, filed on 25 Oct. 2007 now abandoned, the entire content of which is incorporated herein by reference.

FIELD OF THE INVENTION

This invention relates to articles for making a kneepad pocket and for supporting a kneepad inside a trouser leg.

BACKGROUND OF THE INVENTION

Knee protection is important to people who for whatever reason need to kneel on any fairly hard surface. It is especially important to tradespeople who often must kneel on particularly hard surfaces like brick, concrete, etc. while performing their jobs.

One type of knee protection device is held in covering relation to the anterior of the knee by adjustable and/or elastic straps that girdle the leg both above and below the knee. The straps are tightened to some degree around the leg and that may cause some discomfort to the wearer due to constriction of the leg. When worn around a trouser leg, the straps also bunch the trouser material while constricting the leg. Such a knee protection device may be constructed to have a hard outer shell with a softer, cushioned pad lining the inside. When the person wearing such a device stands and ambulates after kneeling, the presence of the device is often noticeable.

An alternate arrangement for knee protection comprises a kneepad disposed in a pocket on the outside of a trouser leg knee. Such a pocket can be sewn onto a new or a used pair of trousers.

The environment in which a person uses knee protection may be one in which debris accumulates on the kneeling surface. A pocket that is not fully closed, or another type of device that is somewhat open, may provide an opportunity for such debris to find its way into the pocket, or between the knee and the protection device, and that is undesirable because intrusion of harder pieces of debris behind the pad or protector will be felt by the wearer, often painfully. In any event, the intrusion of debris, dust, and the like dirty a pocket and pad, and the pad eventually requires removal.

Examples of various knee protection arrangements for use with trousers appear in various patents. Many are poorly suited for use in an environment that contains debris. Many are not especially comfortable to wear. None of those patents that the inventor has seen show or suggest the inventive article that is being disclosed here for enabling a trouser leg to be provided with a kneepad in a novel way.

SUMMARY OF THE INVENTION

One general aspect of the invention relates to a trouser leg as described in claims 1, 9, and 11.

The article comprises first, second, and third parts. The first part comprises a closeable opening having a long dimension transverse to the length of the trouser leg and a first fabric piece providing a perimeter margin surrounding the closeable opening. The second part comprises a second fabric piece that is large enough to cooperate with the trouser leg to form a majority of the pocket when its perimeter margin is disposed against the inside of the trouser leg and attached to the trouser leg. The third part comprises a third fabric piece having a marginal portion that is transverse to the length of the trouser leg attached to a portion of the second fabric piece at a location below a top margin of the second piece and an opposite marginal portion attached to a marginal portion of the first fabric piece that is above the closeable opening.

Another general aspect of the invention relates to an article as described in claim 12.

The second part is disposed inside the trouser leg and attached to the trouser leg to form top, bottom, and sides of the pocket. The third part comprises opposite margins that are transverse to the length of the trouser leg. One margin is attached to the fabric piece of the first part above the closeable opening and the other is attached to the second part below the top of the pocket.

DETAILED DESCRIPTION OF THE INVENTION

Figure 1:
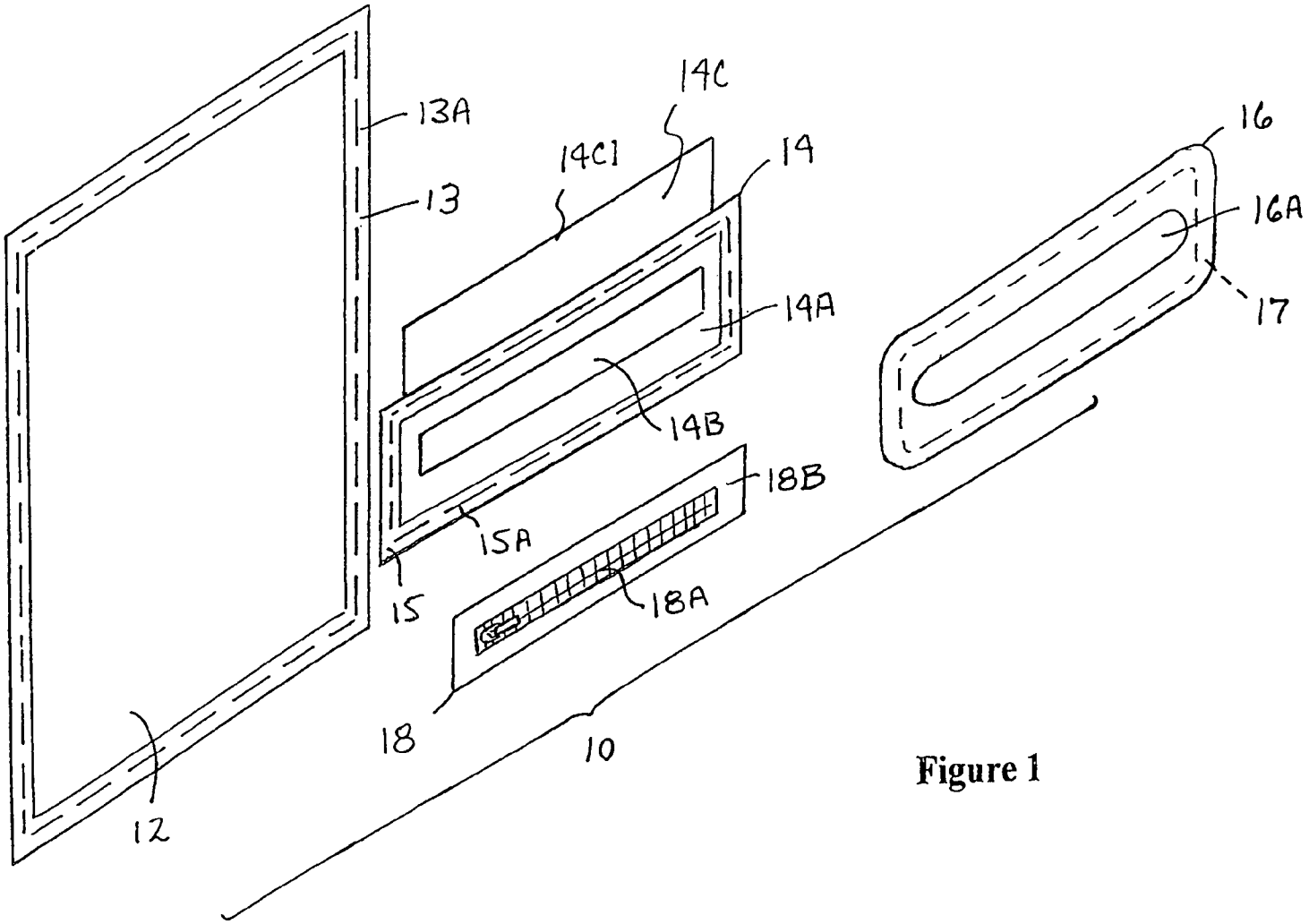
FIG. 1 is an exploded perspective view of a first embodiment of article for creating a pocket in accordance with principles of the present invention.
Figure 2:
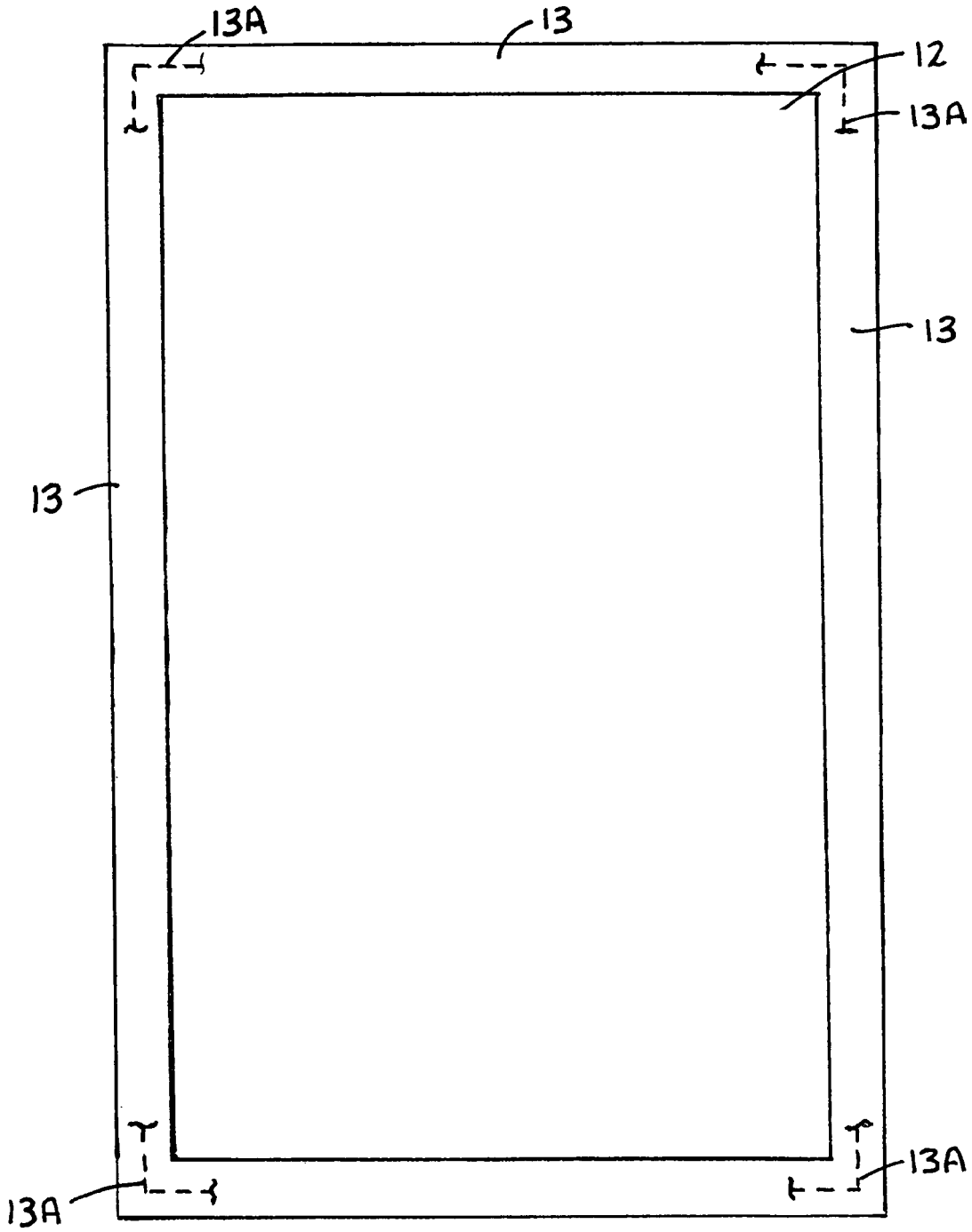
FIG. 2 is a front plan view of one part of the article of FIG. 1.
Figure 3:
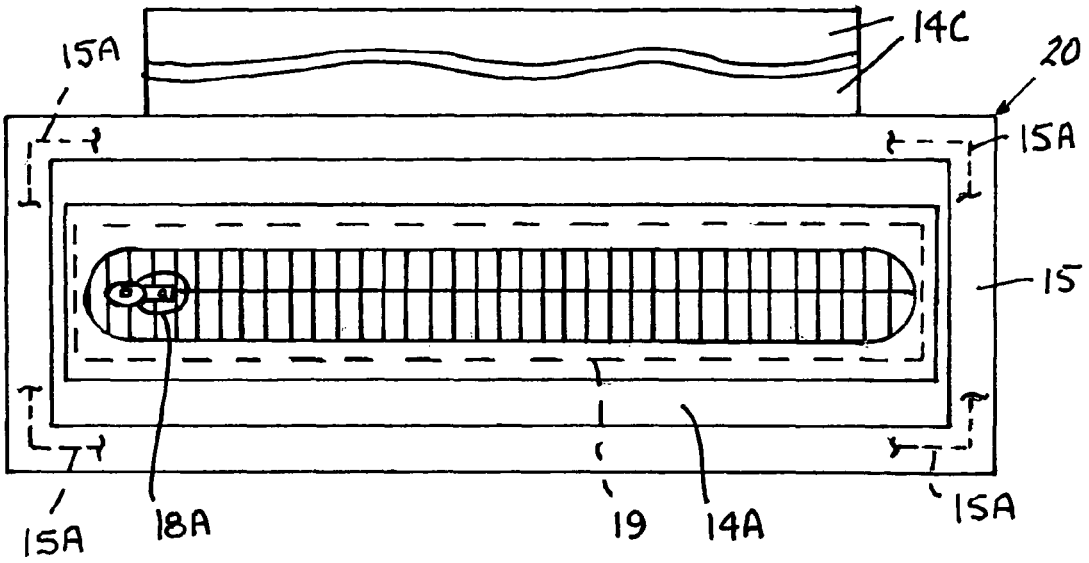
FIG. 3 is a front plan view of another part of the article that has been created by attaching two of the parts of FIG. 1 together.
Figure 4:
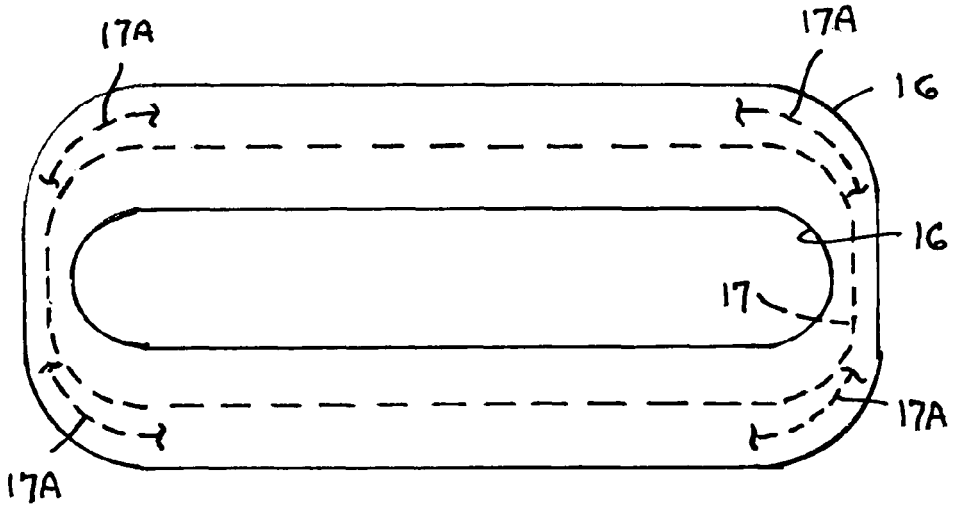
FIG. 4 is a front plan view of still another part of the article of FIG. 1.

FIGS. 1-6 show an article 10 for creating a kneepad-holding pocket on the inside of a trouser leg. Article 10 comprises parts 12, 14, 16, and a slide fastener 18, such as a zipper, shown in FIG. 1. Parts 12, 14, and 16 comprise fabric pieces cut to the shapes illustrated. Article 10 can be fabricated in several sizes, such as a men's size and a women's size, for enabling most people to use them.

Part 12 is a fabric piece cut to rectangular shape to form a back piece that will cooperate with the front of a trouser leg to form the pocket. In an example of a men's size article, piece 12 is 11.75 inches by 8.00 inches. The outer perimeter margin of piece 12 is intended to attach to the inside of a trouser leg (as will be explained) to make the pocket generally rectangular in shape with a top, two sides, and a bottom. For attaching piece 12 to the trouser leg, the outer perimeter margin of the face of piece 12 that is toward the inside of the front of the trouser leg contains an iron-on adhesive strip 13 that is held in place by any suitable means such as stitching 13A extending along the four sides as shown. Strip 13 may be a single piece of iron-on adhesive material or several individual strips of iron-on adhesive material arranged as shown.

Part 14 is a fabric piece which has a rectangular area 14A that is wider than it is high. Area 14A contains an elongate opening 14B centered widthwise in the rectangular area, but somewhat closer to the top than to the bottom. Piece 14 also has a rectangular flap 14C extending from the top of area 14A. The flap is centered along the width of the piece 14 but is not as wide as area 14A. Although area 14A and flap 14C are respective portions of a single cut piece of fabric referred to above as part 14, they may be considered respectively as a first fabric piece of article 10 and a third fabric piece of article 10 with part 12 being considered as a second part comprising a second fabric piece of article 10.

For attaching area 14A to the trouser leg, the face of area 14A that is toward the inside of the front of the trouser leg contains an iron-on adhesive strip 15 that is held in place by any suitable means such as stitching 15A. Strip 15 may be a single piece of iron-on adhesive or several individual strips of iron-on adhesive arranged in the pattern shown. Strip 15 fully surrounds opening 14B but does not have to fully cover area 14A.

Figure 5:
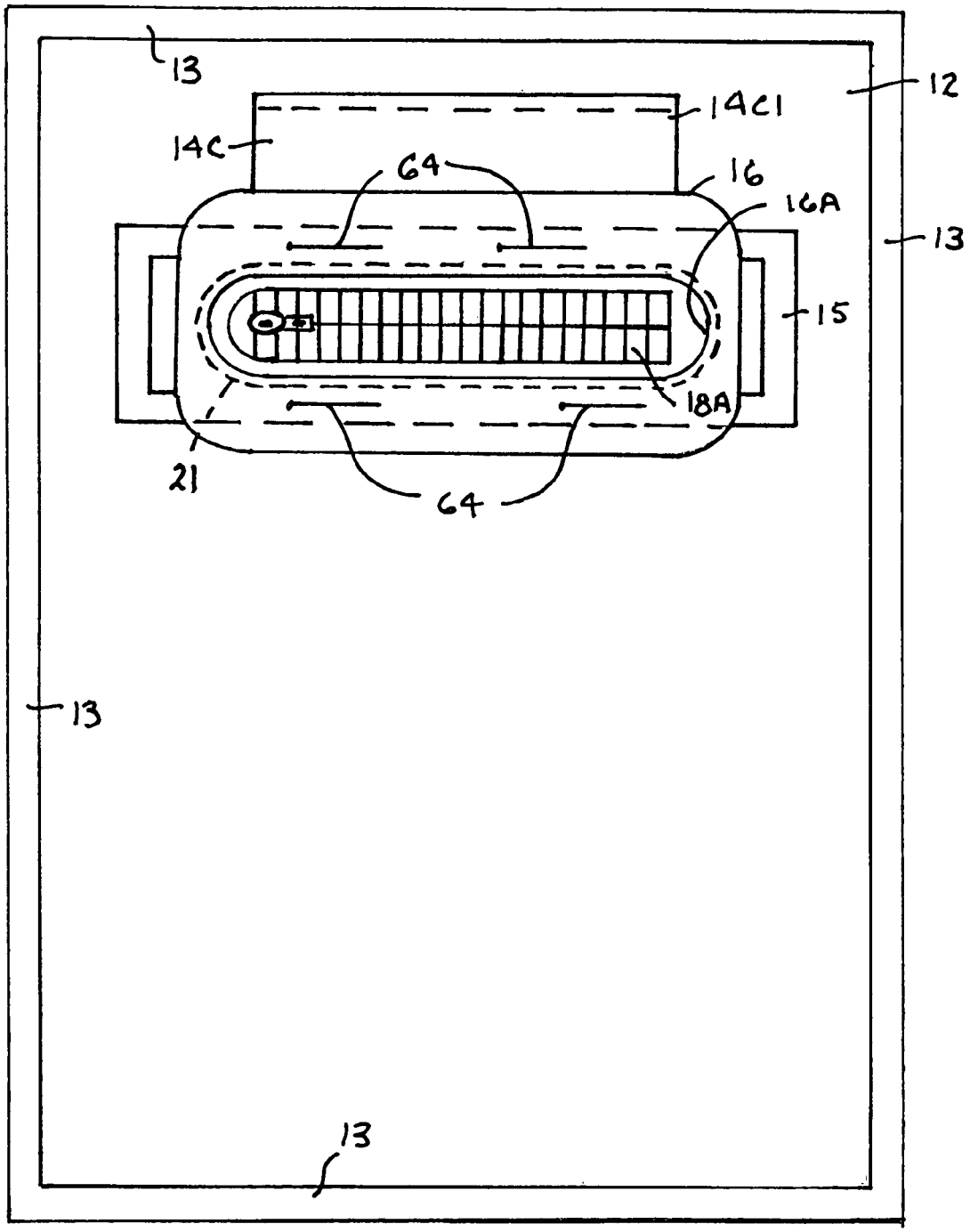
FIG. 5 is a front plan view showing the parts of FIGS. 2, 3, and 4 attached to form the article.
Figure 6:
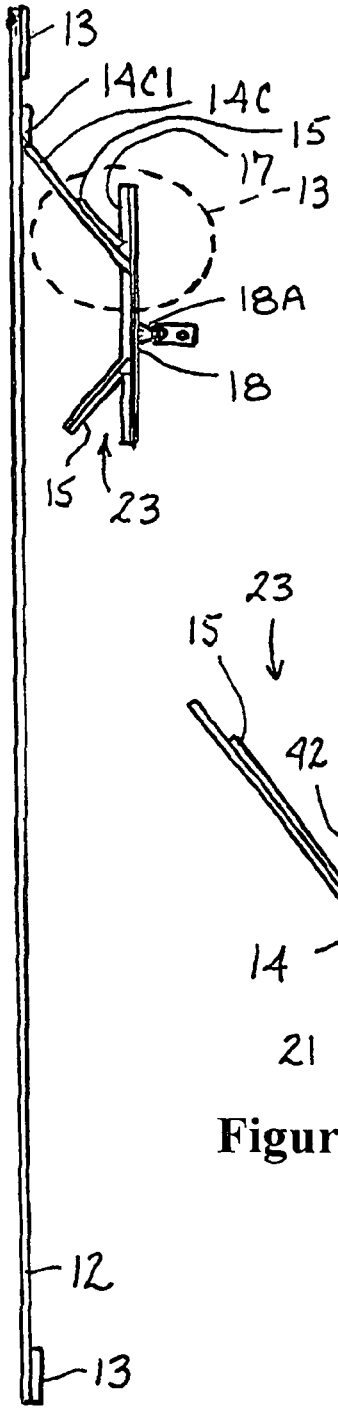
FIG. 6 is a side elevation view of the article of FIG. 1, with one of the parts being flexed.

The purpose of flap 14C is to provide for attachment of pieces 12 and 14 to each other as shown by FIGS. 5 and 6 where the top margin 14C1 of the flap is shown attached, such as by stitching, centrally of the width of piece 12 parallel to and a short distance below the portion of strip 13 running along the top margin of piece 12. Attaching the two pieces 12, 14 together facilitates subsequent attachment of article 10 to the trouser leg and assures that piece 12 is properly located to the trouser leg before strip 13 is ironed to the trouser leg.

Fabric piece 16 may be considered a fourth fabric piece which has a generally rectangular shape that is wider than it is high. The four corners are shown rounded, but could be straight along the edges. Piece 16 contains an elongate opening 16A that is centered in the piece.

For attaching piece 16 to the trouser leg, the inner face of piece 16 that faces toward the outside of the front of the trouser leg contains an iron-on adhesive strip 17 that is held in place by any suitable means such as stitching 17A. Strip 17 may be a single piece of iron-on strip adhesive material or several individual strips arranged in the pattern shown. Strip 17 surrounds opening 16A but does not necessarily have to fully cover the area of piece 16. Preferably however, the outer perimeter of strip 17 is congruent with the outer perimeter of piece 16.

Zipper 18 has the usual mechanism 18A and a surrounding fabric margin 18B that provides for the zipper to be attached to another piece of fabric. Zipper 18 is placed in front of piece 14 so that when mechanism 18A is disposed within opening 14B, the fabric margin 18B overlaps the margin of area 14A surrounding opening 14B, and strip 15 is not covered. Margin 18B and the margin of area 14A surrounding opening 14B are attached together, such as by stitching 19, so that collectively area 14A (the first fabric piece of article 10) and zipper 18 form what may be considered as a first part 20 of article 10.

FIG. 5 shows piece 16 disposed over the front of piece 14 with zipper mechanism 18A centered within opening 16A. Parts 14 and 16 are attached to each other by stitching 21 around the margin surrounding opening 16A so as to leave a crevice 23 between the outer margin of piece 16 that contains strip 17 and outer margin of area 14A that contains strip 15. Crevice 23 extends around the entire margin surrounding stitching 21.

FIGS. 5 and 6 show the finished article 10. In FIG. 5, piece 14 is essentially flat against piece 12. It can be seen that area 14A is wider than piece 16. In FIG. 6, flap 14C is not flat against piece 12, but is flexed to show zipper 18 moved to a position that is spaced forwardly (to the right in the drawing) of piece 12 but still connected to piece 12 by flap 14C. When piece 14 is disposed flat against piece 12, the entire article 10 is generally flat and suitable for packaging and sale in that condition.

Next, how article 10 is used to create a kneepad pocket will be described.

Figure 7:
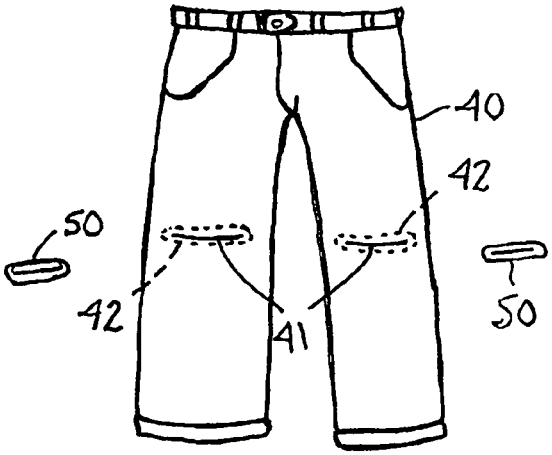
FIG. 7 is a front view of a pair of trousers with cutouts made just above the knee for installing the pocket-creating articles in the trouser legs.
Figure 8:
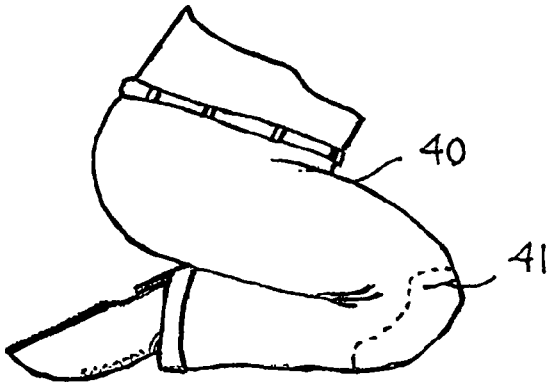
FIG. 8 is a partial side view of a person wearing the trousers to show how they are marked so that the cutouts will be in proper locations.

FIG. 7 shows a pair of trousers 40 containing markings 41 just above the knees that are used for making cutouts 42 shown in broken lines. Proper locations in the trouser legs for the cutouts are made by a person putting on the trousers and squatting down as shown in FIG. 8. With a taylor's chalk, or other suitable marker, the person makes the markings 41 by drawing a line across the width of each trouser leg about one inch above the top of each knee cap.

Figure 9:
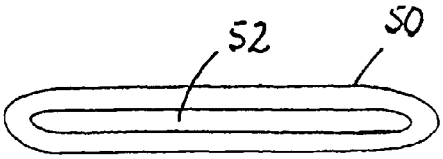
FIG. 9 is a plan view of an accessory that can be used for preparing a trouser leg.

After the lines have been marked, the trousers are then removed and laid out on a flat surface. A tracing pad, or template, 50 shown in FIG. 7 to the outside of each trouser leg and on a larger scale in FIG. 9, is a flat piece of material, such as plastic, that has an elongate opening 52 running widthwise. The outer perimeter edge of the tracing pad corresponds to the shape of material to be cut out of each trouser leg to make a cutout 42.

Opening 52 is placed on a marking 41, and the cutout is traced on the trouser leg by using taylor's chalk to trace around the outer perimeter edge of the tracing pad. Opening 52 is generally centered widthwise of the trouser leg. If the line 41 that was marked while the person was kneeling is not generally parallel with the width of the trouser leg, the tracing pad can be turned as required so that opening 52 is better aligned with the trouser leg width before tracing. The trouser legs are then cut around the tracings to remove elongate pieces of material that leave the cutouts 42. Care should be taken to cut through only the front of each trouser leg. A typical size for a cutout is 4.75 inches by 0.5 inches.

Figure 13:
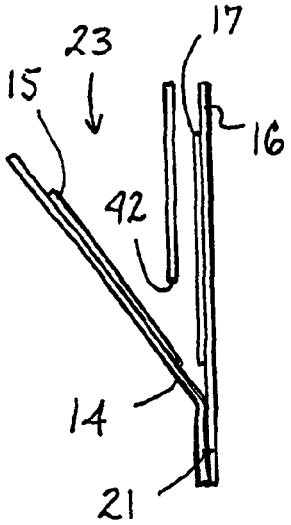
FIG. 13 is an enlarged view in circle 13 of FIG. 6 illustrating more detail.

After a cutout has been made, the article 10 is then associated with the front of a trouser leg so that the margin of the cutout 42 lodges in the crevice 23, as shown by FIG. 13, with pieces 12 and 14 being disposed on the inside of the trouser leg and piece 16 is on the outside. Piece 16 is positioned so that the length of zipper 18 is substantially true with the elongate cutout and so that the margin of piece 16 is substantially flat against the margin of the cutout. In that position, piece 16 is temporarily pinned to the front of the trouser leg at locations such as those indicated at 64 in FIG. 5.

The trouser leg is turned inside out and placed on a flat surface. Piece 12 is folded about flap 14C out of the way so that the margin of area 14A that contains the iron-on strip 15 is uncovered. The sides of that margin are then ironed to cause the underlying portions of strip 15 to adhere to the inside of the trouser leg. Because those sides are beyond the sides of piece 16, care in ironing them will avoid also melting the side portions of strip 17 and hence avoid adhering part 16 to the front of the trouser leg at this time. The longer portions of strip 15 that run across the top and bottom margins remain unironed at this time.

Piece 12 is then folded back flat against the inside of the trouser leg and its margin is ironed to cause strip 13 to adhere the margin of piece 12 to the trouser leg thereby forming the pocket.

Next the trouser leg is turned right side out and the back of the leg is placed against an underlying surface so that piece 16 is facing up. The margin of piece 16 is unpinned and then ironed to cause strip 17 to adhere the piece to the trouser leg. The trouser leg can be then once again be turned inside out and the ironing of piece 14 to the trouser leg completed.

Figure 10:
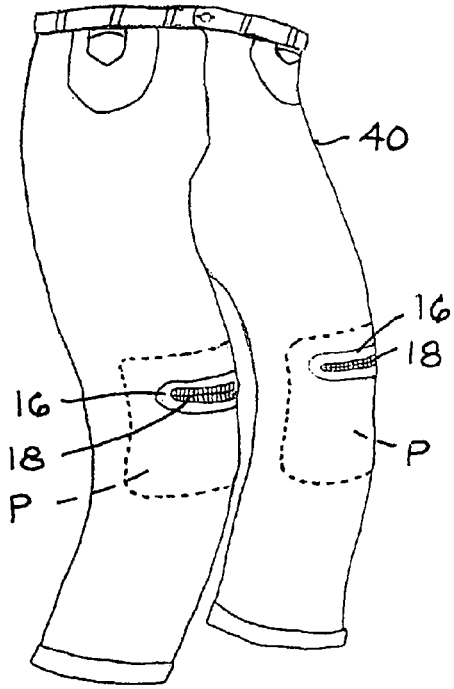
FIG. 10 is a perspective view of the trousers after the articles have been installed.

A complete pocket P has now been created inside one leg with a zippered opening in the front of the leg. The process is repeated for the other leg. With each zipper open, a respective pad (not shown) of suitable material can be inserted through it from the front of the trouser leg into the respective pocket. The zippers are then zipped shut. FIG. 10 shows the completed installations in the two trouser legs.

Figure 12:
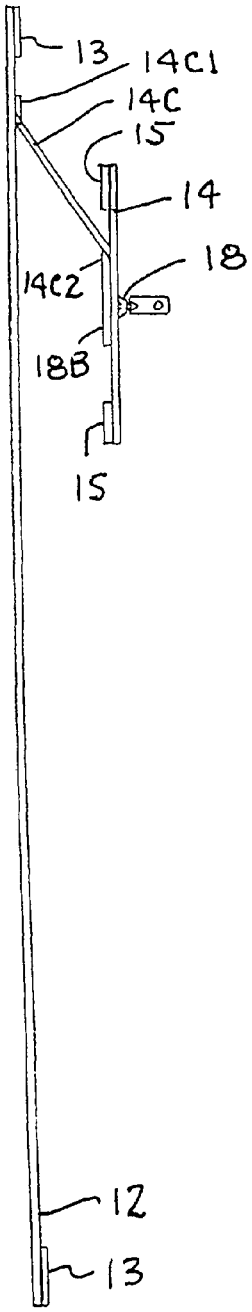
FIG. 12 is a view similar to FIG. 6 of the second embodiment.
Figure 11:
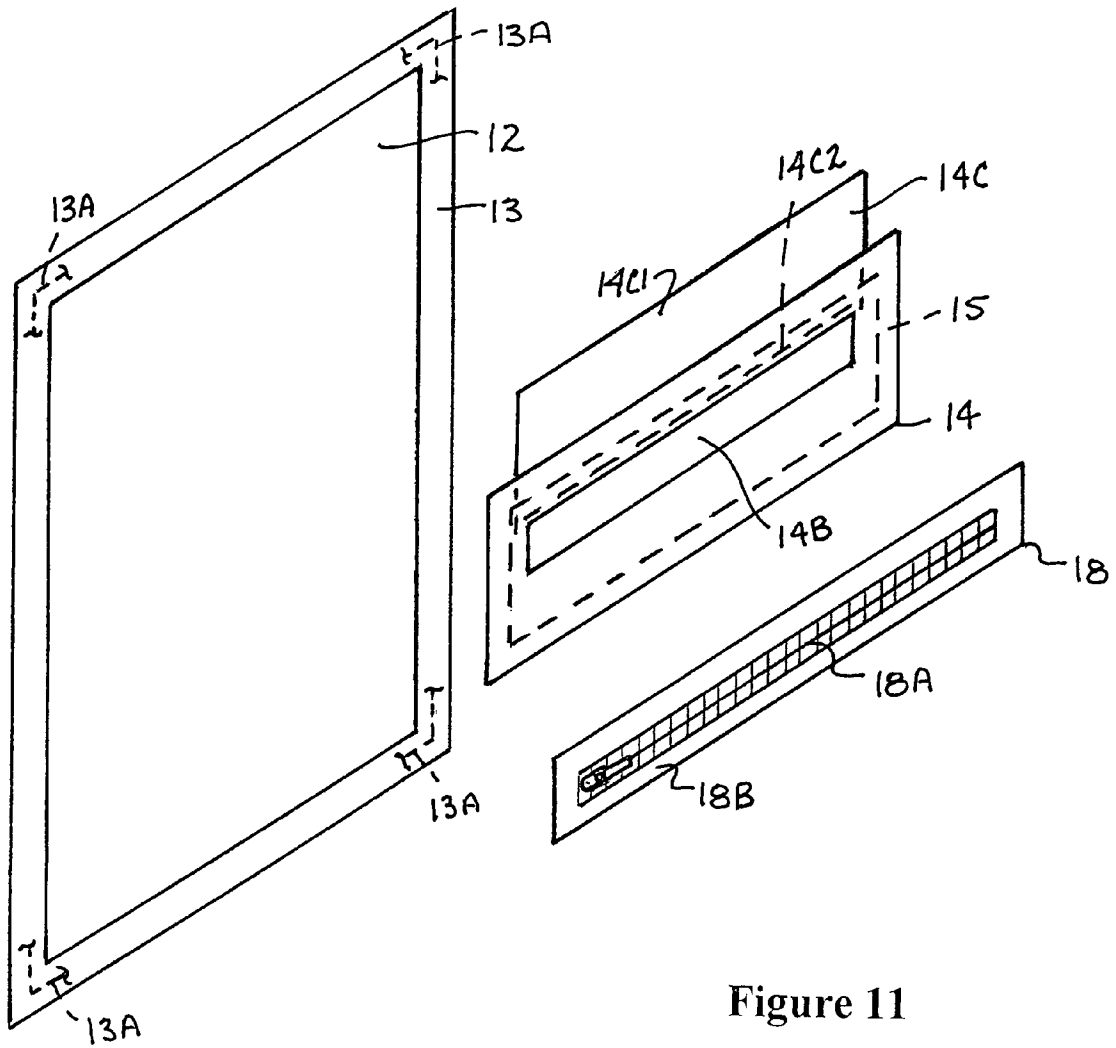
FIG. 11 is a view similar to FIG. 1 showing a second embodiment of the article.

The second embodiment of article 10 shown in FIGS. 11 and 12 is like the first in that the top margin of flap 14C is stitched to piece 12 in the same way that the top margin 14C1 of flap 14C is in FIGS. 5 and 6. It is however different in that flap 14C is a separate cut piece of fabric that is stitched to a separate cut piece 14 that in the second embodiment may be considered equivalent to area 14A of the first embodiment. Flap 14C can have the same or different width as in the first embodiment.

The second embodiment differs in that piece 16 is not used. Zipper 18 is stitched to piece 14, being placed either in front of or behind piece 14, preferably the latter, so that zipper mechanism 18A is in registration with opening 14B.

The bottom widthwise margin of flap 14C is stitched to fabric of the stitched-together fabric margin 18B of zipper 18 and piece 14 at a location just above zipper mechanism 18A and below the portion of the iron-on strip 15 that runs along the top margin of piece 14.

A further difference is that strip 15 is on the face of piece 14 that is toward piece 12 because piece 14 will be on the outside of the front of the trouser leg. Consequently the zipper is in effect attached only to the outside of the front of the trouser leg whereas in the first embodiment it is in effect attached both to the outside and the inside.

Because flap 14C of the second embodiment is attached along its top margin to piece 12 and along its bottom margin to fabric to which the zipper is stitched, correct placement of the zipper in the trouser leg cutout assures that the piece 12 will be properly located to create the kneepad pocket in the proper location.

The second embodiment is installed by pinning piece 14 in proper location, placing piece 12 flat against the inside of the trouser leg, ironing piece 12 to the inside of the trouser leg, and ironing piece 14 to the outside.

When a kneepad of suitable size is placed in a pocket created by any embodiment of the inventive article, the fabric of the trousers and article allow the interior of the pocket to conform to the thickness of the kneepad.

The use of a zipper enables the pocket to be closed to dust and debris when the trousers are used. It also enables the kneepad to be conveniently inserted into and removed from the pocket. The flexibility of the fabric of the article combined with flexibility of the trouser fabric allow for some length, width, and thickness of the kneepad, and that capability is useful in providing for the use of different density pad material, some of which is thicker and some of which is thinner. Such choice of pad material may be important to a particular person.

Figure 14:
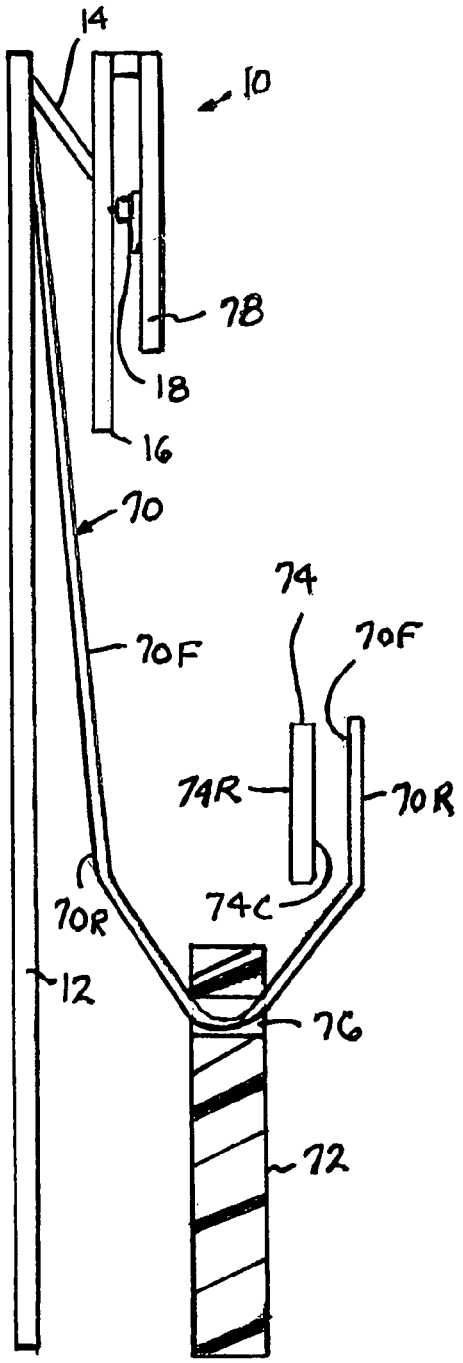
FIG. 14 is view similar to FIGS. 6 and 12 showing a third embodiment.
Figure 15:
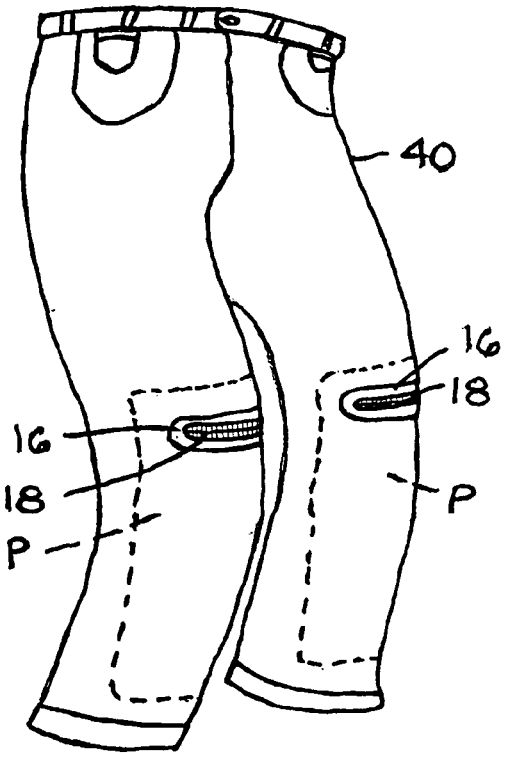
FIG. 15 is a perspective view similar to FIG. 10 showing a pair of trousers with which the embodiment of FIG. 14 is used.

The article 10 shown in FIG. 14 has components like those of the embodiment shown in FIG. 12, but not all of them are shown. Part 12 is longer so that when the article is installed in a pair of trousers, as in FIG. 15, the kneepad pockets P that are created extend further down the trouser leg than in FIG. 10. The article shown in FIG. 14 also includes a tether 70 for suspending a kneepad 72 within a pocket P. Tether 70 can be a long band or strap that is fastened at its upper end in any suitable way to the article. When kneepad 72 is suspended, its weight, although not large, is enough to pull on the tether so that the kneepad is suspended at a desired depth inside the pocket.

Rather than depending upon the bottom of the pocket P to vertically locate the kneepad in the pocket, the embodiment of FIG. 14 possesses the ability to vertically set the location of the kneepad within the pocket. This is because the tether's effective length can be set to allow the kneepad to be suspended at any of various heights along the length of the trouser leg. The side margins of piece 12 that are fastened to the trouser leg to provide for piece 12 to cooperate with the front of the trouser leg in creating the kneepad pocket are placed against the inside of the leg in locations that properly locate the kneepad widthwise of the trouser leg so that the kneepad will fit in the pocket and can be freely vertically suspended by the tether. The bottom of piece 12 does not necessarily have to be stitched to the trouser leg, allowing the pocket to be open at the bottom. In addition to allowing the kneepad to be suspended at various depths in a pocket, various embodiments of the suspension also allow the kneepad to be disconnected from the tether and removed from the pocket.

The tether 70 in FIG. 14 is an example of a hook-type Velcro™ strip 70 having Velcro™ hooks on the front face 70F. A small piece 74 has Velcro™ loop-type material on both its front face 74F and its rear face 74R. The front face 74F attachably/detachably attaches to tether face 70F along a free end portion of the tether's length that has passed through a slot 76 in kneepad 72 to extend upward from kneepad 72 in front of the more rearward suspending portion of the strap 70. The more that the free end portion is pulled up, the higher that the kneepad is suspended. When the kneepad has been suspended at a desired height with the front face 74F of piece 74 attached to the strap, the rear face 74R is forced against face 70F of the suspending portion of the strap to complete the attachment. The kneepad is supported by the bottom of the U- or V-shaped loop formed in the strap. In this way, the location at which the piece 74 releaseably attaches to the suspending portion of strap 70 determines how far down the tether, and hence how deep in the pocket, the kneepad will be when it hangs inside the pocket.

While piece 74 could have loop-type Velcro™ only on face 74R and be stitched or bonded to the free end of strap 70, the use of double-sided Velcro™ for piece 74 provides the advantage of shortening the length of strap 70 to allow a kneepad to be suspended even higher. Piece 74 can be detached from the strip, an appropriate amount of the free end length cut off and discarded, and the piece 74 re-attached.

By detaching either face of piece 74 from strap 70, the strap can be pulled out of slot 76 to allow the kneepad to be removed from the pocket.

It is to be noticed that the article in FIG. 14 also includes a flap 78 that covers the zipper, but can be lifted to allow the zipper to be zipped and unzipped. The flap can help in keeping dirt and debris away from the zipper.

Figure 16:
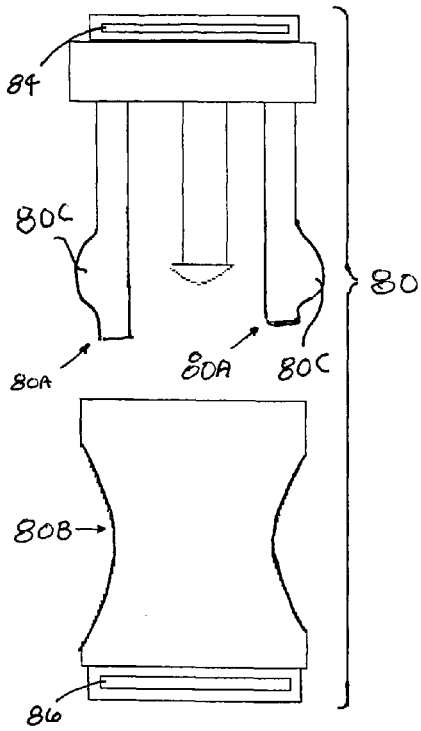
FIG. 16 is an enlarged plan view showing two parts of a connector used in some embodiments.
Figure 17:
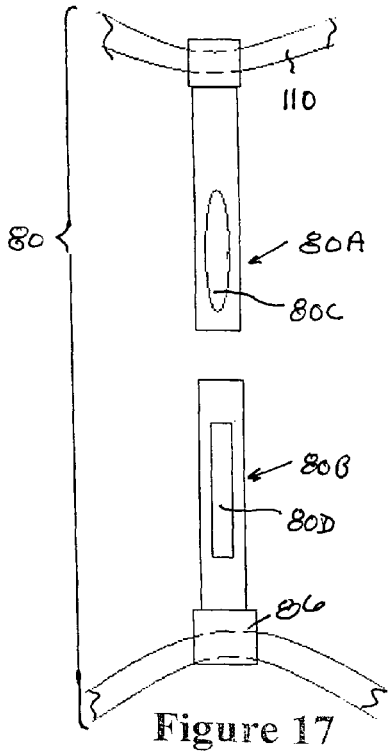
FIG. 17 is a side view of FIG. 16.

FIGS. 16 and 17 show a separable connector, a gaiter clip 80 for example, for allowing a kneepad to be disconnected from and reconnected to a tether. One part 80A of the connector has fingers 82 that flex inward as their ends are pushed into an open end of an opposite part 80B. When parts 80A and 80B are fully attached to each other, bumps 80C on the sides of the fingers lodge in slots 80D to keep the two parts connected. To release the connection, the fingers are squeezed together by squeezing on the bumps so that they clear slots 80D, allowing the two parts 80A, 80B to be pulled apart. The top of part 80A comprises a horizontal slot 84, and the bottom of part 80B comprises a horizontal slot 86. These slots provide for respective straps to pass through each part 80A, 80B, as will be explained later.

Figure 18:
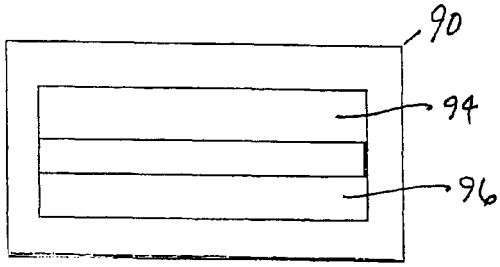
FIG. 18 is a plan view of a part used in FIG. 20.
Figure 19:
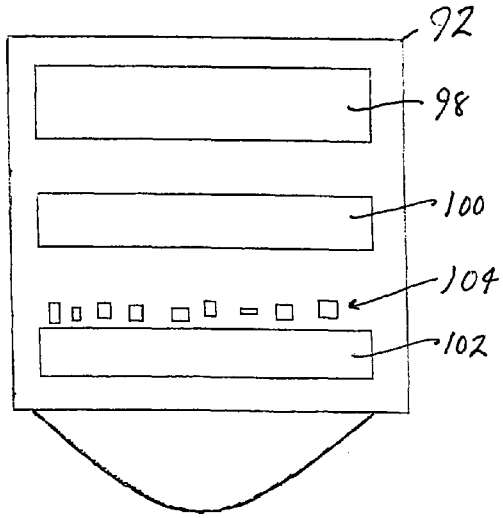
FIG. 19 is a plan view of a part used in FIG. 21.

A tether that uses a gaiter clip can have a D-ring or double D-ring for setting the effective length of the tether, and hence setting the height of a kneepad along the inside of a trouser leg. FIG. 18 shows a D-ring 90 by itself, and FIG. 19 shows a double D-ring 92. D-ring 90 has two parallel slots 94, 96. Double D-ring 92 has three parallel slots 98, 100, 102; it also has a series of small raised protuberances 104. The slots in each type of the ring provide for a respective strap to pass through, as will be explained.

Figure 20:
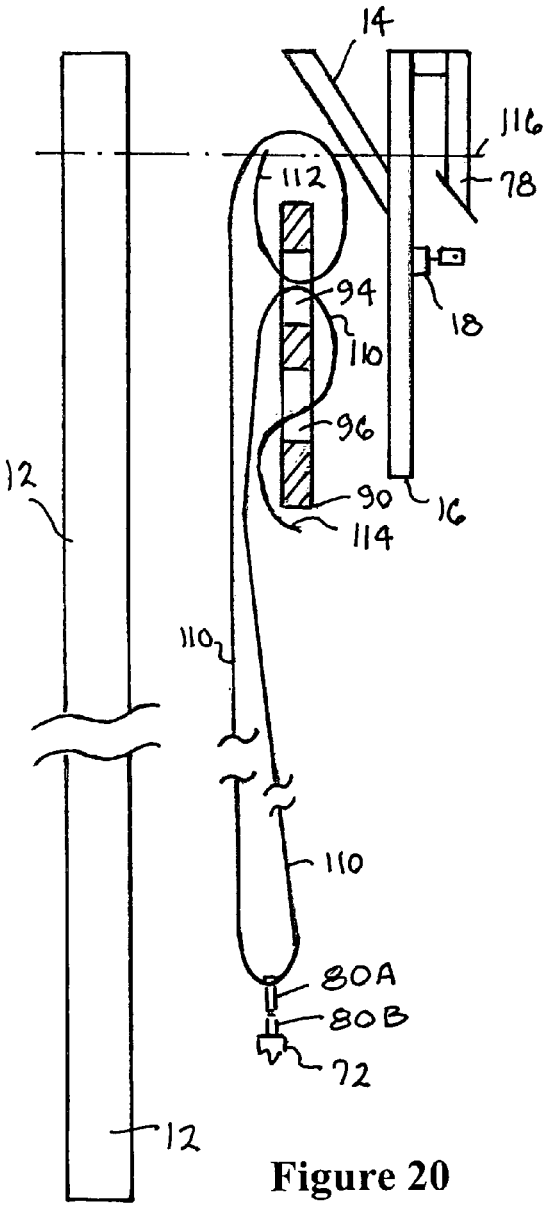
FIG. 20 is a side view showing another embodiment.

FIG. 20 shows the use of D-ring 90 to set the height of a kneepad 72 inside a trouser leg. A strap 110 has a length extending from one end 112 to an opposite end 114. Beginning at end 112, the strap runs downwardly to pass through slot 94 from front to rear and then upwardly to loop over and around end 112. From there the strap extends downwardly behind the D-ring to pass through slot 84 of gaiter part 80A from rear to front. It then extends upwardly to pass through slot 94 from rear to front below the portion of the strap that already extends through that slot. From there, it extends downwardly to pass through slot 96 from front to rear, finally ending at end 114. The gaiter part 80B is directly attached to the kneepad to stay with the kneepad when the gaiter parts 80A, 80B are disconnected from each other. Alternately part 80B could be attached to the kneepad by a looped strap that passes through slot 86 and whose ends are attached to the kneepad, as shown in FIG. 17.

A sew line is indicated by the numeral 116. The parts through which the sew line passes are sewn along a generally horizontal line across the width of the trouser leg when the article is properly associated with the cutout in the front of the trouser leg in the manner explained earlier. The side margins of piece 12, and optionally the bottom margin, are attached to the trouser leg. When zipper 18 is unzipped, the tether and kneepad can be accessed through it. If the bottom margin of piece 12 is left unattached to the trouser leg, then access to the pocket interior is also available through its open bottom.

The effective length of the tether that suspends the kneepad is adjustable. The various embodiments presented here show various means for accomplishing adjustment. In FIG. 20, the extent to which end 114 is pulled downwardly through slot 96 sets the effective length. It is to be appreciated that the showing of FIG. 20 is not to scale and intended to be schematic of how the strap is threaded through the various slots. The material of the strap and its thickness in relation to the sizes of the D-ring slots provide both fits and friction for allowing adjustment and for maintaining an adjustment once made. The strap can be any suitable material, a woven fabric being just one of many examples.

Figure 21:
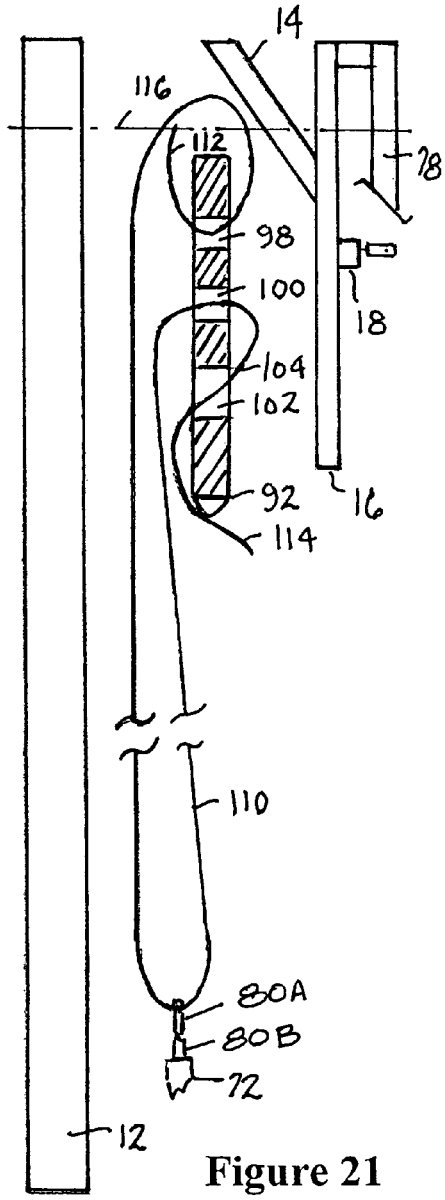
FIG. 21 is a side view showing still another embodiment.

FIG. 21, like FIG. 20, is also schematic. As strap 110 comes upward from connector 80 toward double D-ring 92, it passes first through slot 100 from the rear and then downwardly and through slot 102 from front to rear. The protuberances 104 aid in holding the adjusted strap in adjusted position.

Because of the presence of gaiter clip 80, the embodiments of FIGS. 20 and 21 allow the kneepad to be disconnected from the strap without unthreading the strap from either the D-ring or the double D-ring. All that is necessary is to disconnect part 80B from part 80A. However by unthreading the strap from the D-ring and double D-ring and sliding it out of the slot 84 in part 80A, the kneepad can also be separated from the strap with the gaiter clip staying with the kneepad.

Figure 22:
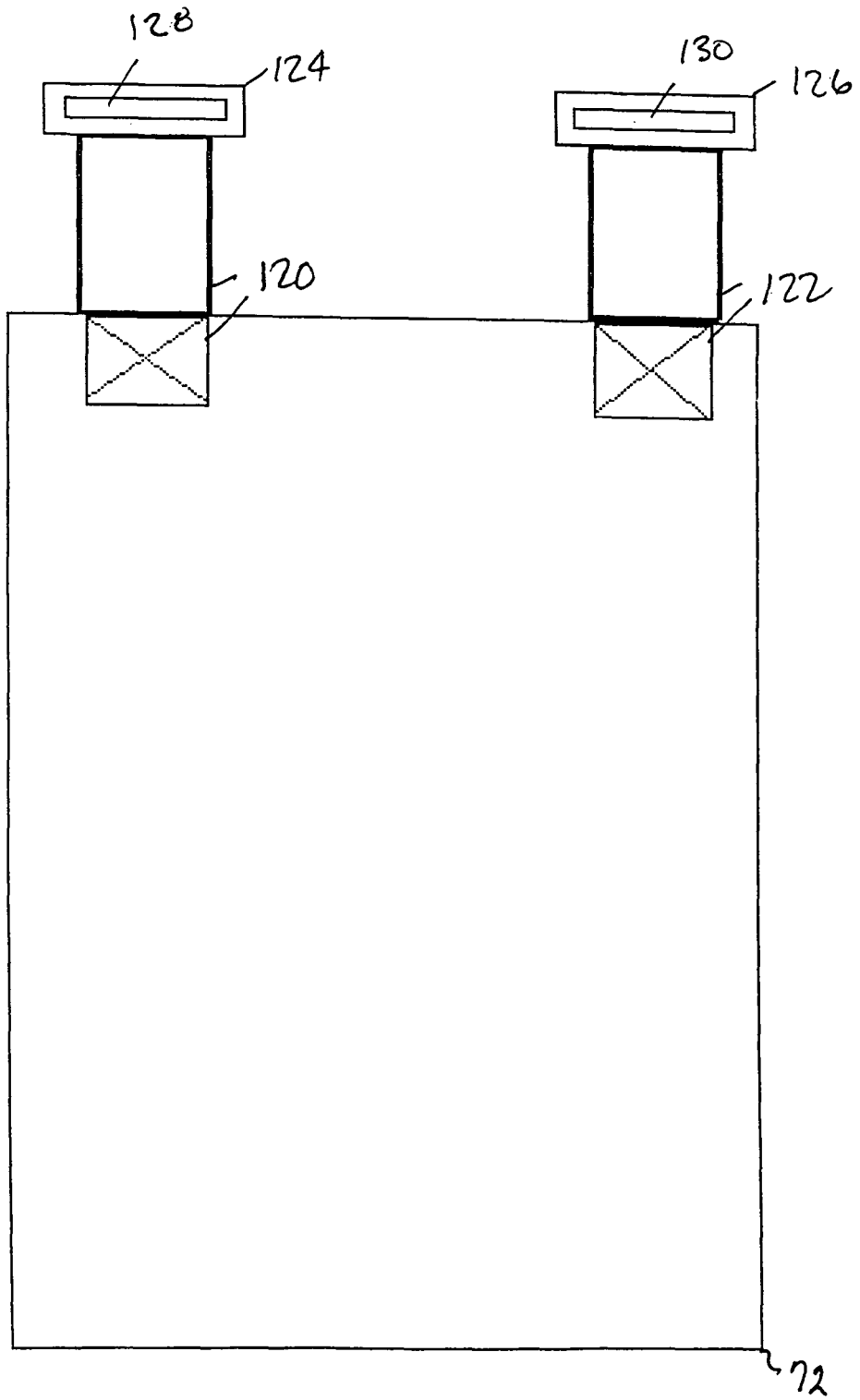
FIG. 22 is a front plan view of another embodiment of a kneepad.

While FIG. 14 shows the kneepad having a centrally located slot 76 through which a single suspension strap passes to suspend the kneepad, FIG. 22 shows a different kneepad 72 with a different suspension. Short straps 120, 122 are attached at their lower ends to the kneepad symmetrically to either side of a vertical centerline through the kneepad. A respective ring 124, 126 with a respective horizontal slot 128, 130. An arrangement like that of FIG. 14 but using two straps like strap 70, each running through a respective slot 128, 130, can be used to suspend the kneepad of FIG. 22. A respective piece 74 is used with each strap, as in FIG. 14.

Figure 23:
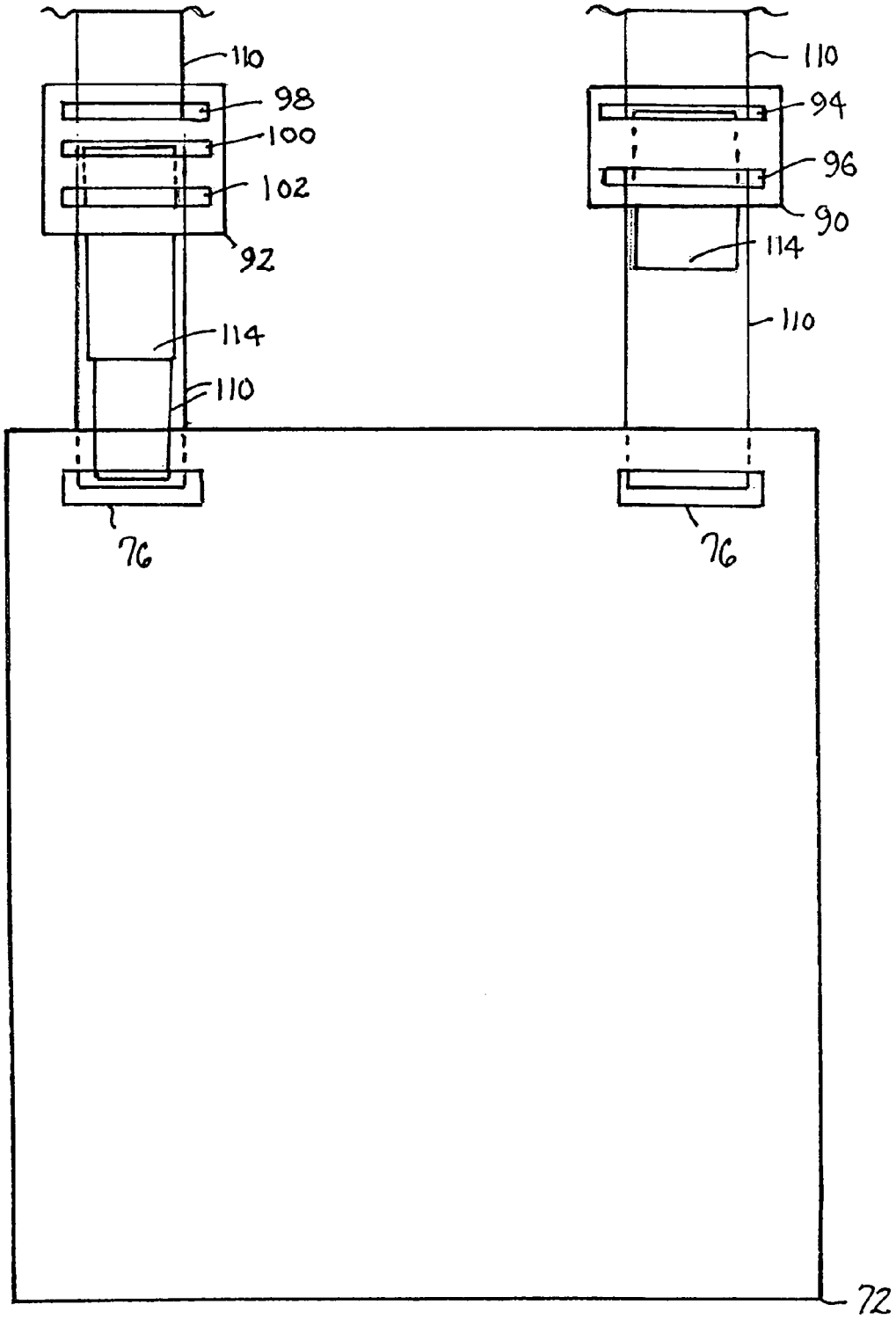
FIG. 23 is a front plan view of a kneepad using the part of FIG. 18 and the part of FIG. 19.
Figure 24:
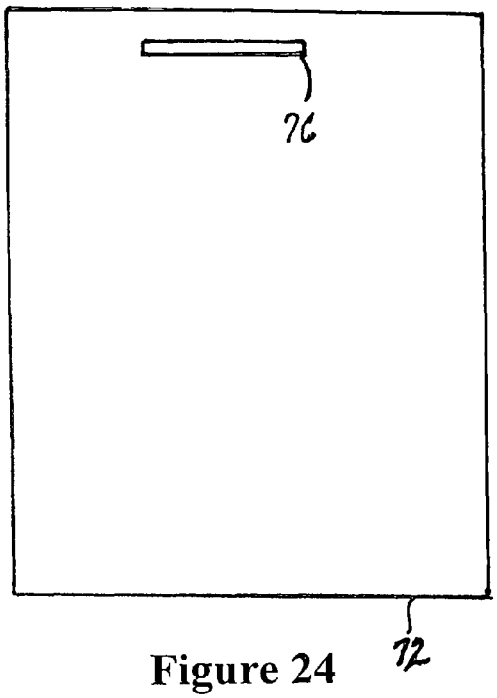
FIGS. 24-27 are plan views of other kneepads.
Figure 25:
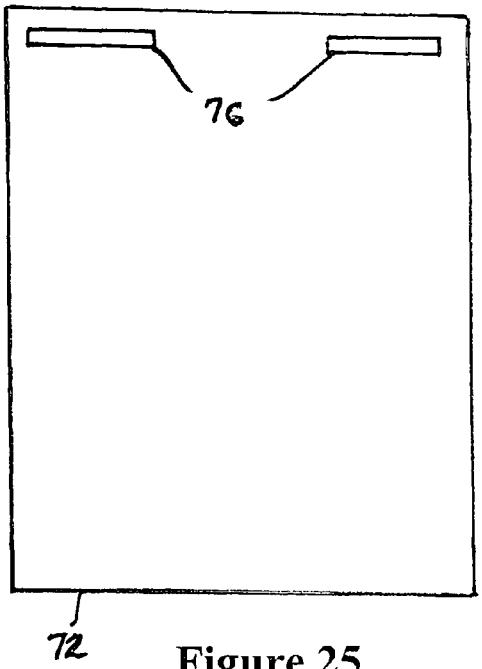
Figure 26:
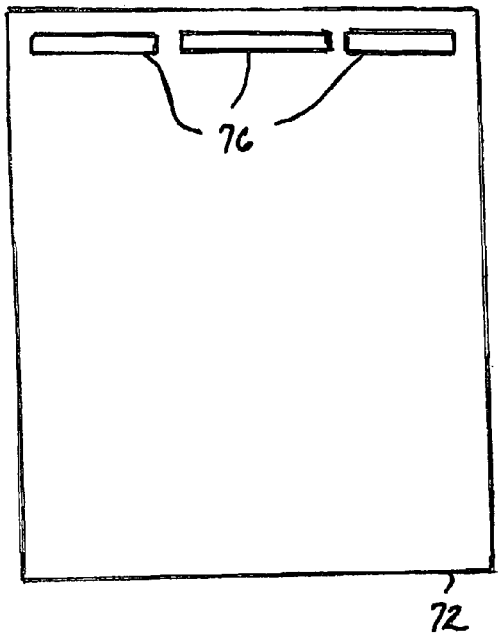
Figure 27:
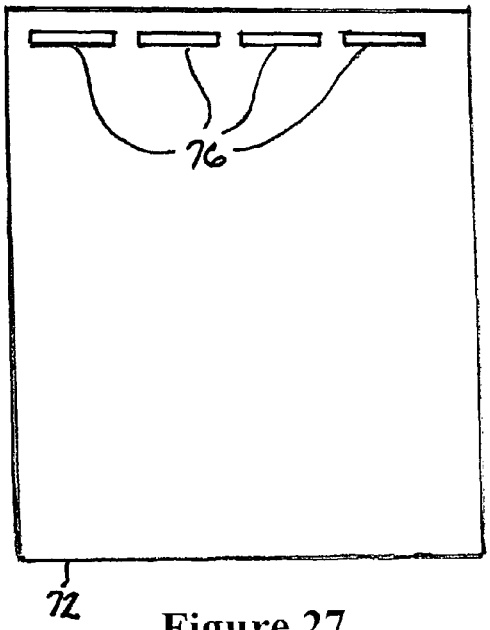

FIG. 23 shows that different adjustment means can be used on either side of a kneepad. The one on the left uses the double D-ring 92 and a strap running through one of two slots 76 in the kneepad 72. The one on the right uses the D-ring 90 and a strap running through the other of the two slots in the kneepad 72. The straps thread through the slots in the respective rings in the same manner as in FIGS. 20 and 21. FIG. 23 shows the straps' widths extending for some distance from ends 114 to be slightly reduced in comparison to the remainder of the straps for clarity of illustration.

FIGS. 24-27 shows kneepads with one, two, three, and four slots 76 respectively. The use of more than one strap may provide better side-to-side balance in the suspension so that the kneepad tends to hang straighter.

While a presently preferred embodiment of the invention has been illustrated and described, it should be appreciated that principles of the invention apply to all embodiments falling within the scope of the following claims.

What is claimed is:

1. A trouser leg comprising:

a kneepad disposed on an inside of the trouser leg behind a knee of the trouser leg, a tether attached to the trouser leg above the knee of the trouser leg and extending downward within the inside of the trouser leg from where it is attached to the trouser leg to suspend the kneepad, and one or more elements for adjusting how far down the trouser leg the tether suspends the kneepad and for enabling the kneepad to be disconnected from the tether for removal from the trouser leg, an article which creates a kneepad pocket on the inside of the trouser leg in front of a person's knee, the article comprising:

a first part comprising a closeable opening having a long dimension transverse to the length of the trouser leg and a first fabric piece providing a perimeter margin surrounding the closeable opening, the first part being fit to a cut-out in the trouser leg with the first fabric piece being attached to the trouser leg;

a second part comprising a second fabric piece that is disposed against the inside of the trouser leg and attached to the trouser leg and that cooperates with the trouser leg to form a majority of the kneepad pocket; and a third fabric piece having a marginal portion that is transverse to the length of the trouser leg attached to a portion of the second fabric piece at a location below a top margin of the second piece and an opposite marginal portion attached to a marginal portion of the first fabric piece that is above the closeable opening;

the tether being attached to the trouser leg above the closeable opening.

2. A trouser leg as set forth in claim 1 including adhesive adhering the outer margin of a face of the first fabric piece to the trouser leg, and an adhesive adhering the outer margin of a face of the second fabric piece to the trouser leg.

3. A trouser leg as set forth in claim 2 in which the second fabric piece has a rectangular shape that is longer along the length of the trouser leg than along the width of the trouser leg, and the third fabric piece has a rectangular shape that is longer along the width of the trouser leg than along the length of the trouser leg.

4. A trouser leg as set forth in claim 1 further comprising a fourth fabric piece which comprises an area of fabric that contains a through-opening having a long dimension that is transverse to the length of the trouser leg, a margin of the area of fabric surrounding the through-opening is attached to a margin of the first part surrounding the closeable opening, and adhesive adhering a face of the area of fabric, that is in surrounding relation to the attachment of the margin of the area of fabric surrounding the through-opening, to the margin of the first part surrounding the closeable opening.

5. A trouser leg as set forth in claim 4 including adhesive adhering the outer margin of a face of the first fabric piece to the trouser leg, and adhesive adhering the outer margin of a face of the second fabric piece to the trouser leg.

6. A trouser leg as set forth in claim 5 in which the second fabric piece has a rectangular shape that is longer along the length of the trouser leg than along the width of the trouser leg, and the area of fabric of the third piece has a rectangular shape that is longer along the width of the trouser leg than along the length of the trouser leg.

7. A trouser leg as set forth in claim 6 in which the width of the area of fabric of the third fabric piece extends beyond widthwise ends of the first part.

8. A trouser leg as set forth in claim 1 in which the closeable opening comprises a slide fastener.

9. A trouser leg comprising:

a kneepad disposed on an inside of the trouser leg behind a knee of the trouser leg, a tether attached to the trouser leg above the knee of the trouser leg and extending downward within the inside of the trouser leg from where it is attached to the trouser leg to suspend the kneepad, and one or more elements for adjusting how far down the trouser leg the tether suspends the kneepad and for enabling the kneepad to be disconnected from the tether for removal from the trouser leg, the tether comprises a strap that has hook-type material on one face and that loops through a slot associated with the kneepad to cause a portion of the one face along a free end portion of the strap to confront a portion of the one face of a suspending portion of the strap, and a one of the elements comprises a piece of loop-type material attachably/detachably attaching the confronting portions to each other.

10. A trouser leg as set forth in claim 9 in which the piece of loop-type material attachably/detachably attaching the confronting portions to each other has loop-type material on opposite faces for attachably/detachably attaching to hook-type material on both confronting portions.

11. A trouser leg comprising:

a kneepad disposed on an inside of the trouser leg behind a knee of the trouser leg, a tether attached to the trouser leg above the knee of the trouser leg and extending downward within the inside of the trouser leg from where it is attached to the trouser leg to suspend the kneepad, and one or more elements for adjusting how far down the trouser leg the tether suspends the kneepad and for enabling the kneepad to be disconnected from the tether for removal from the trouser leg; and the one or more elements for adjusting how far down the trouser leg the tether suspends the kneepad and for enabling the kneepad to be disconnected from the tether for removal from the trouser leg are arranged to provide the disconnection function at a lower height than the adjustment function.

12. An article for enabling a kneepad pocket to be created on the inside of a trouser leg in front of a person's knee and for enabling a kneepad to be suspended at a desired location within the kneepad pocket, the article comprising:

a first part comprising a closeable opening having a long dimension transverse to the length of the trouser leg and a first fabric piece providing a perimeter margin which surrounds the closeable opening and which, when disposed against a margin of the inside of the trouser leg surrounding a cut-out in the trouser leg, locates the closeable opening in the cut-out;

a second part comprising a second fabric piece that is large enough to cooperate with the trouser leg to form a majority of the pocket when its perimeter margin is disposed against the inside of the trouser leg and attached to the trouser leg;

a third fabric piece having a marginal portion that is transverse to the length of the trouser leg attached to a portion of the second fabric piece at a location below a top margin of the second piece and an opposite marginal portion attached to a marginal portion of the first fabric piece that is above the closeable opening; and a tether attached to the article above the closeable opening and extending downward in front of the second fabric piece for suspending a kneepad, the tether comprising one or more elements for adjusting how far down the second fabric piece will suspend a kneepad and for enabling a kneepad to be disconnected from the tether.

13. An article as set forth in claim 12 further including a kneepad suspended by the tether.

14. An article as set forth in claim 12 in which the second fabric piece has a rectangular shape that is longer along the length of a trouser leg than along the width of a trouser leg, and the third fabric piece has a rectangular shape that is longer along the width of a trouser leg than along the length of a trouser leg.

15. An article as set forth in claim 12 further comprising a fourth fabric piece which comprises an area of fabric that contains a through-opening having a long dimension that is transverse to the length of a trouser leg, a margin of the area of fabric surrounding the through-opening is attached to a margin of the first part surrounding the closeable opening, and iron-on adhesive is disposed on a face of the area of fabric that is toward the first part in surrounding relation to the attachment of the margin of the area of fabric surrounding the through-opening to the margin of the first part surrounding the closeable opening.

* * * * *